US006390775B1

(12) United States Patent
Paz

(10) Patent No.: US 6,390,775 B1
(45) Date of Patent: May 21, 2002

(54) GAS TURBINE BLADE WITH PLATFORM UNDERCUT

(75) Inventor: Eduardo Enrique Paz, Albany, NY (US)

(73) Assignee: General Electric Company, Schenectady, NY (US)

( * ) Notice: Subject to any disclaimer, the term of this patent is extended or adjusted under 35 U.S.C. 154(b) by 1 day.

(21) Appl. No.: 09/749,268

(22) Filed: Dec. 27, 2000

(51) Int. Cl.[7] ..... F01D 5/14
(52) U.S. Cl. ..... 416/193 A
(58) Field of Search ..... 416/193 A, 223 R, 416/234, 235, 236 R, 248

(56) References Cited

U.S. PATENT DOCUMENTS 4,062,638 A * 12/1977 Hall, Jr. ..... 416/244 A
4,714,410 A * 12/1987 Hancosk ..... 416/193 A
5,135,354 A * 8/1992 Novotny ..... 416/193 A X
5,435,694 A * 7/1995 Kray et al. ..... 416/219 R
5,800,124 A * 9/1998 Zelesky ..... 416/95
5,924,699 A * 7/1999 Airey et al. ..... 416/193 A X
5,947,687 A 9/1999 Mori et al. ..... 416/193 A
6,213,711 B1 * 4/2001 Muller et al. ..... 416/236 R X

* cited by examiner

*Primary Examiner*—John E. Ryznic
(74) *Attorney, Agent, or Firm*—Banner & Witcoff, Ltd.

(57) ABSTRACT

A gas turbine moving blade includes a platform which is undercut with a groove. The groove extends from the concave side to the trailing edge side of the platform, where the groove exits the platform. The groove has a depth which will enter a stress line causing a change to the load path direction away from the trailing edge. The location and depth of the groove reduces both high thermal stress and mechanical stress arising at a connection portion of a blade trailing edge and the platform of the gas turbine air cooled moving blade during transient engine operation as well as steady state, full speed, full load conditions.

8 Claims, 8 Drawing Sheets

GAS TURBINE BLADE WITH PLATFORM UNDERCUT

BACKGROUND OF THE INVENTION

The present invention relates to a gas turbine moving blade, and, more particularly, to a gas turbine blade having a platform undercut with improved thermal stress relief.

Gas turbine blades, also referred to as buckets, are exposed to high temperature combustion gases, and, consequently, are subject to high thermal stresses. Methods are known in the art for cooling the blades and reducing the thermal stresses. FIGS. 1–3 show one example of a prior art air-cooled moving blade. High pressure air 2, discharged from a compressor, is introduced into an interior of an air-cooled blade from a blade root bottom portion 4. The high pressure air, after cooling a shank portion 6, a platform 8 and a blade profile portion (or airfoil) 10, flows out of fine holes 12 provided at a blade face, or out of fine holes 14 provided at a blade tip portion. Also, fine holes 12 are provided at a blade trailing edge portion 13 of the blade, through which the high pressure air flows to cool the trailing edge of the blade. Thus, the high pressure air cools the metal temperature of the moving blade.

Highly cooled gas turbine buckets experience high temperature mismatches at the interface of the hot airfoil and the relatively cooler shank portion of the bucket platform. These high temperature differences produce thermal deformations at the bucket platform, which are incompatible with those of the airfoil. In the prior art, the airfoil is attached to a bucket platform that is of greater stiffness than the airfoil. When the airfoil is forced to follow the displacement of the shank and platform, high thermal stresses occur on the airfoil, particularly in the thin trailing edge region. These high thermal stresses are present during transient engine operation as well as steady state, full speed, full load conditions, and can lead to crack initiation and propagation. These cracks potentially can ultimately lead to catastrophic failure of the component.

U.S. Pat. No. 5,947,687 discloses a gas turbine moving blade (FIGS. 1–3) having a groove 16 on the trailing side 18 of the platform of a turbine blade, designed to suppress a high thermal stress at the attachment point of the airfoil trailing edge and platform that occurs during transient operating conditions, i.e., starting and stopping of the turbine. However, the groove has a depth which does not enter a stress line of the platform caused by the load on the airfoil. Since the groove does not enter a stress line, it does not affect the load path through the trailing edge of the airfoil, and the groove is, therefore, not highly stressed. Also, this groove extends along the entire length of the platform, from the concave side 20 of the blade to the convex side 24, along a circumference of the turbine, parallel to a plane of rotation of the turbine. In this configuration, the groove affects blade natural frequencies, thereby potentially inducing additional mechanical vibratory stress on the blade.

BRIEF SUMMARY OF THE INVENTION

It is therefore seen to be desirable to reduce the likelihood of initiating cracks in the root trailing edge region of the airfoil by reducing the thermal and mechanical stresses that occur due to the mismatch between the airfoil and the shank.

The present invention provides a gas turbine moving blade in which a groove is introduced in the bucket platform, at an angle with respect to a mean camber line of the airfoil, such that the groove begins on the concave side of the platform and exits the platform on the trailing edge side of the bucket shank cover plate. In alternative embodiments, the cross-section of the groove may be circular, elliptical, or square with simple or compound radii, rectangular, or polygonal, in which the groove is defined by two or more planes. This groove has a depth which will enter a stress line of the platform caused by a load encountered by the blade, and will change the load path direction away from the trailing edge.

The location and depth of the groove of the present invention results in a reduced mechanical as well as thermal stress condition in the airfoil root trailing edge and a higher stressed condition in the groove. An increase in the fatigue capability of this region of the component is possible because the groove is located in a region of cooler metal temperatures having greater material fatigue strength. This groove, additionally, provides a decrease in the mechanical stress in the trailing edge by cutting into the load path of the airfoil, thus having an overall greater benefit in the fatigue life of the region.

DETAILED DESCRIPTION OF THE INVENTION

Figure 1:
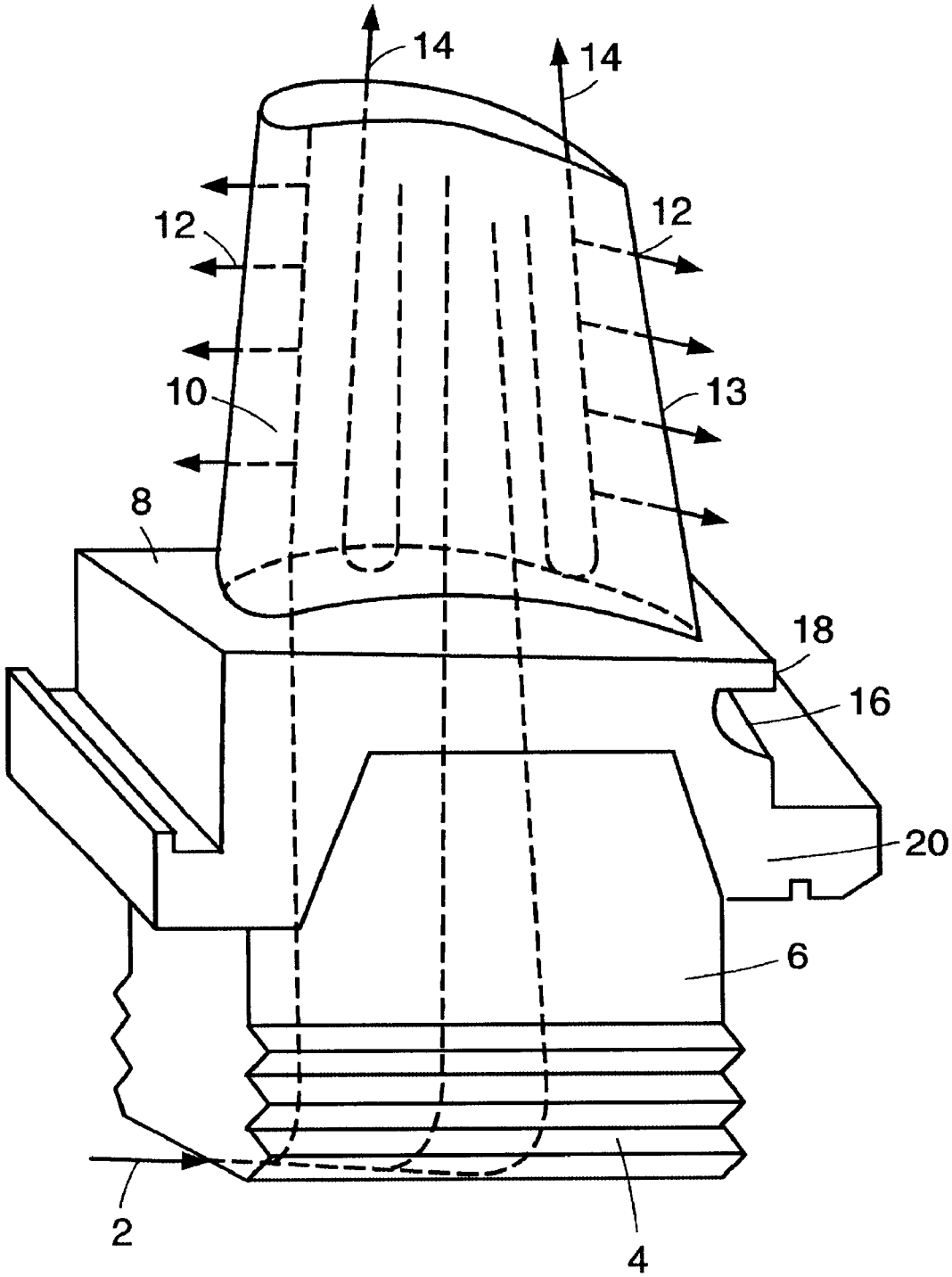
FIG. 1 PRIOR ART
FIG. 1 is a perspective view of a prior art turbine blade.
Figure 2:
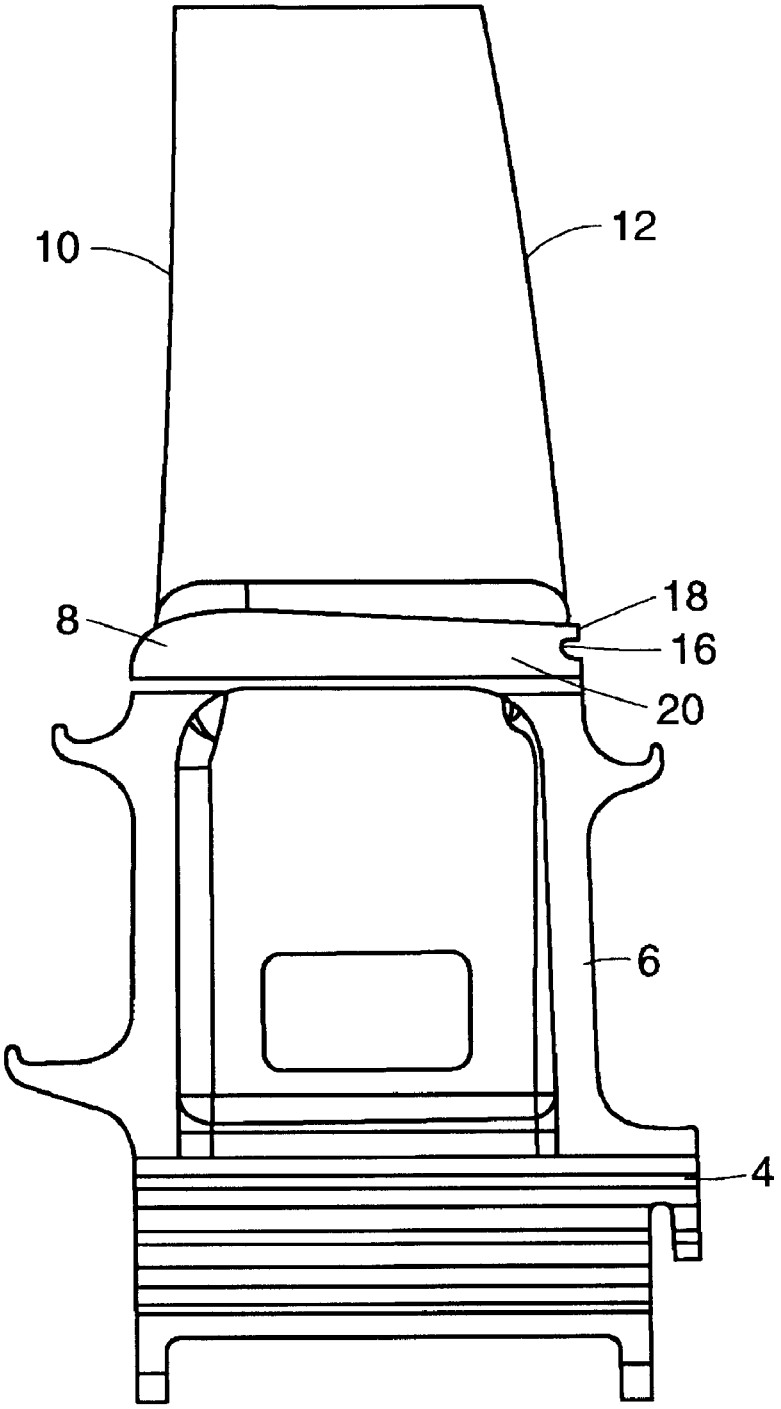
FIG. 2 PRIOR ART
FIG. 2 is a front side view showing an example of a prior artturbine blade.
Figure 3:
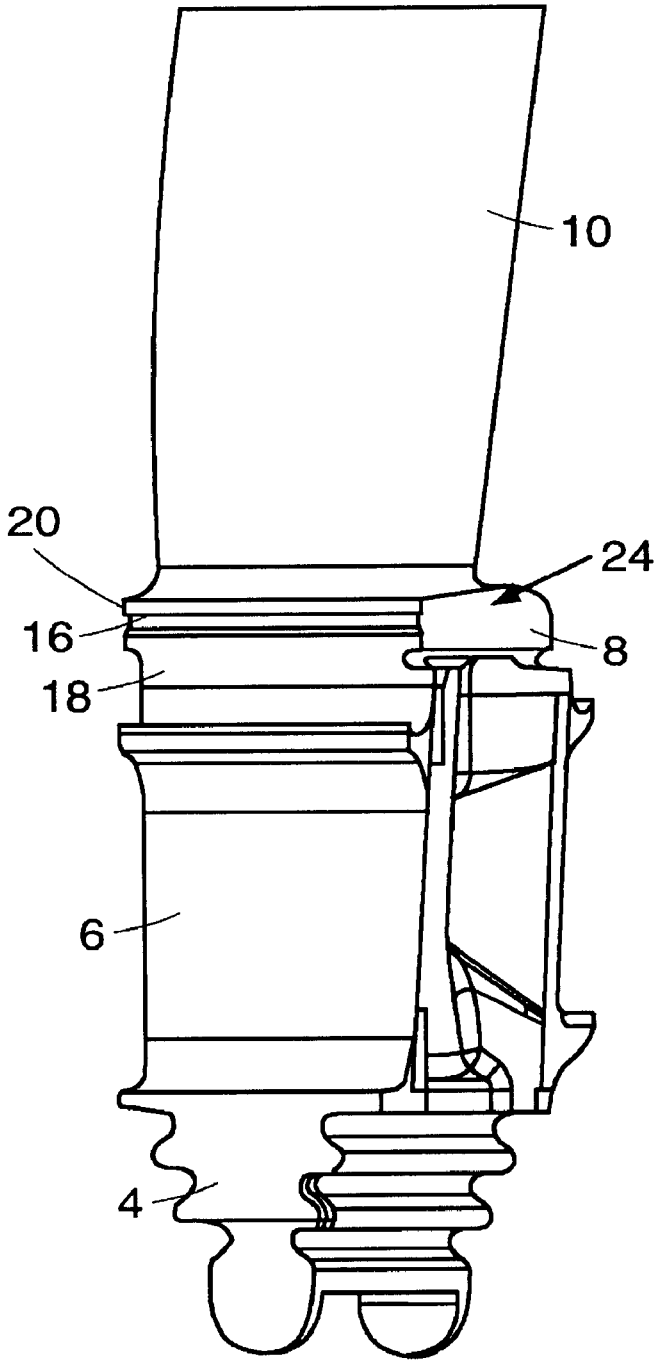
FIG. 3 PRIOR ART
FIG. 3 is right side view of the example of a prior art turbine blade illustrated in FIG. 2.
Figure 4:
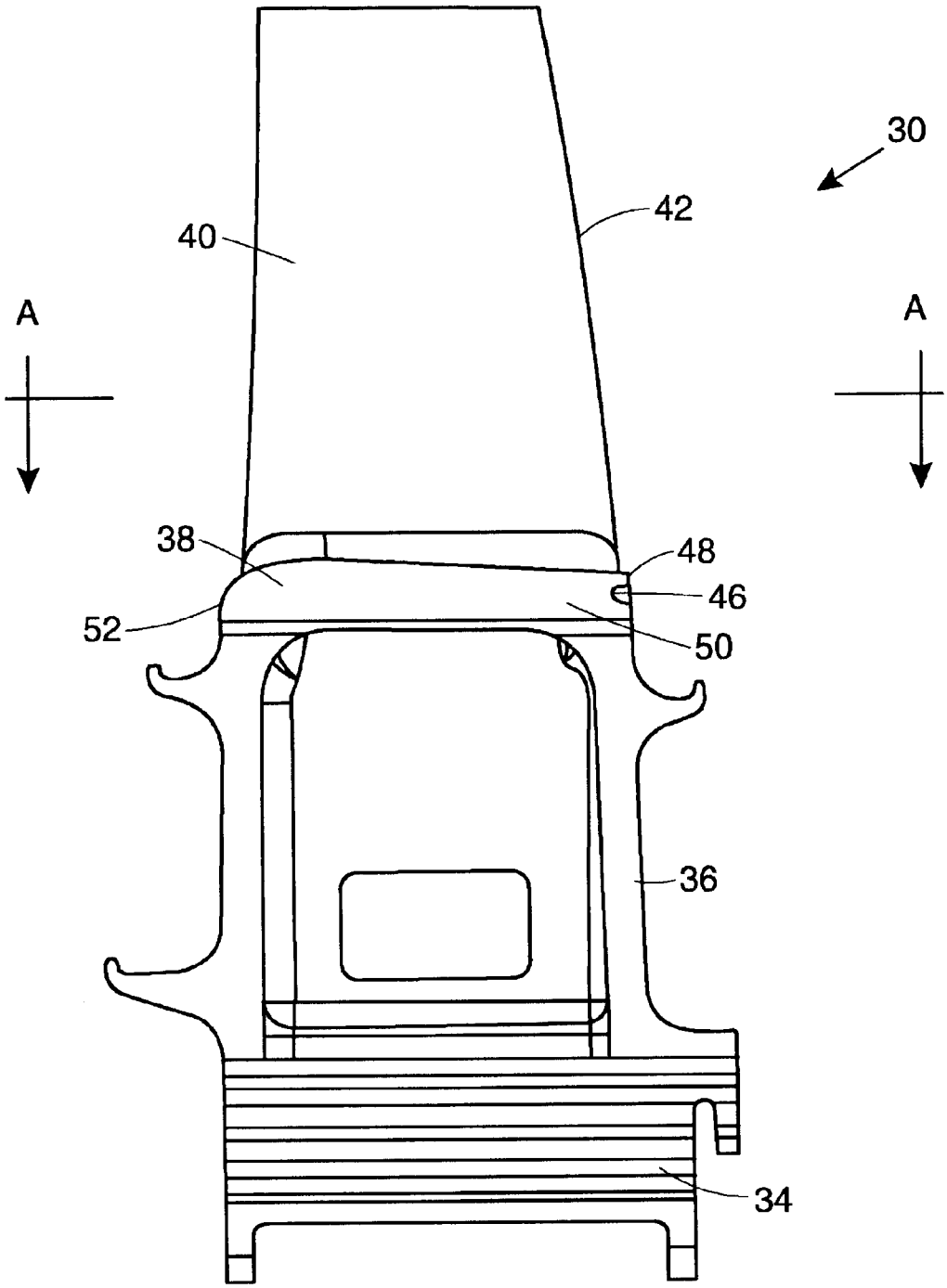
FIG. 4 is a front side view showing a preferred embodiment of a turbine blade according to the present invention.
Figure 5:
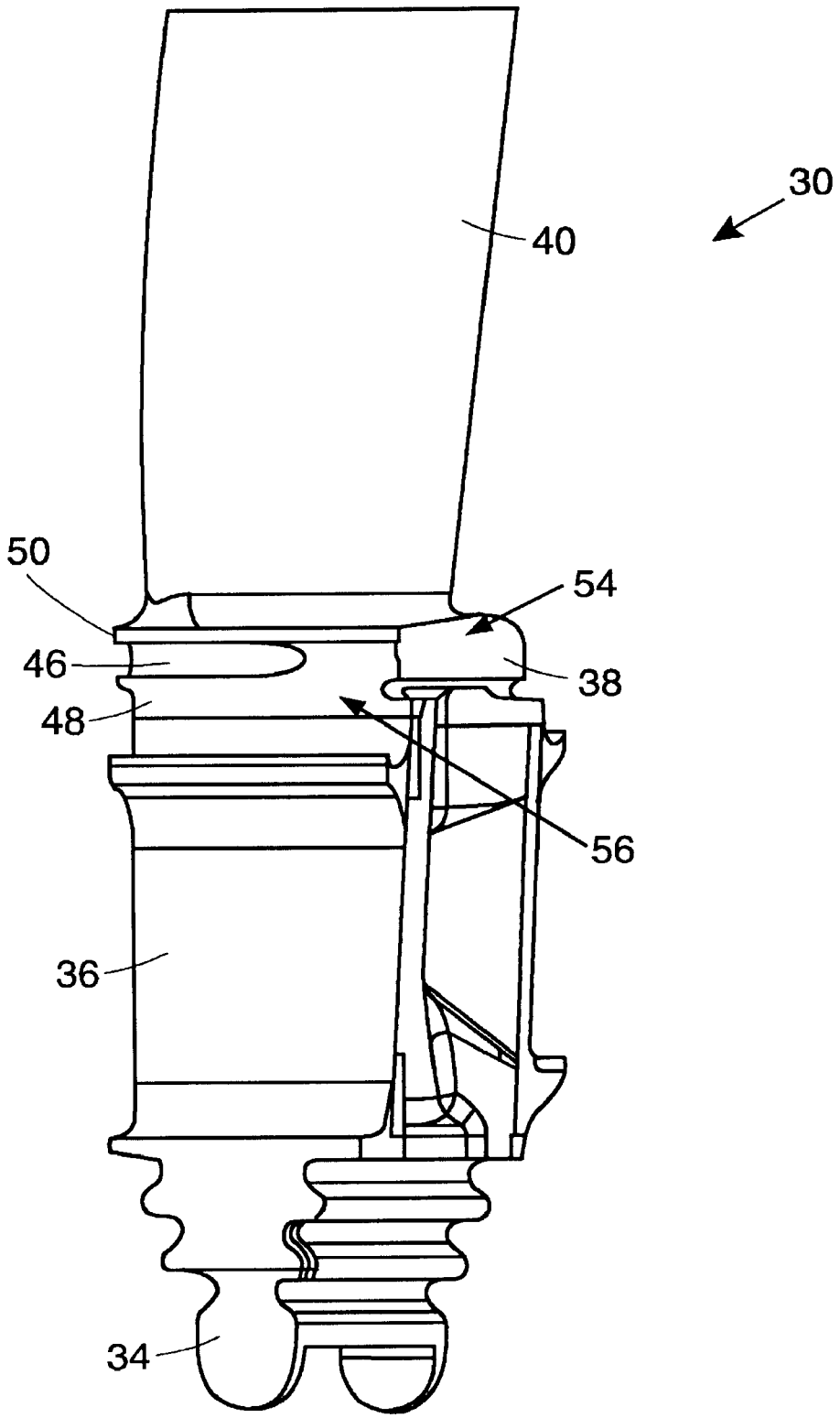
FIG. 5 is a right side view of the turbine blade illustrated in FIG. 4.

In a preferred embodiment of the present invention, as seen in FIGS. 4–5, a turbine blade 30 has a blade root portion 34, a shank portion 36, a blade platform 38, and a blade profile portion (or airfoil) 40. The platform has a trailing edge side 48, a concave side 50, a leading edge side 52, and a convex side 54, where the sides are labeled according to their position relative to the blade profile portion 40. A groove 46 is provided in the platform 38, such that the groove 46 extends from the concave side 50 to the trailing edge side 48 of the platform 38, where the groove exits the platform.

Figure 6:
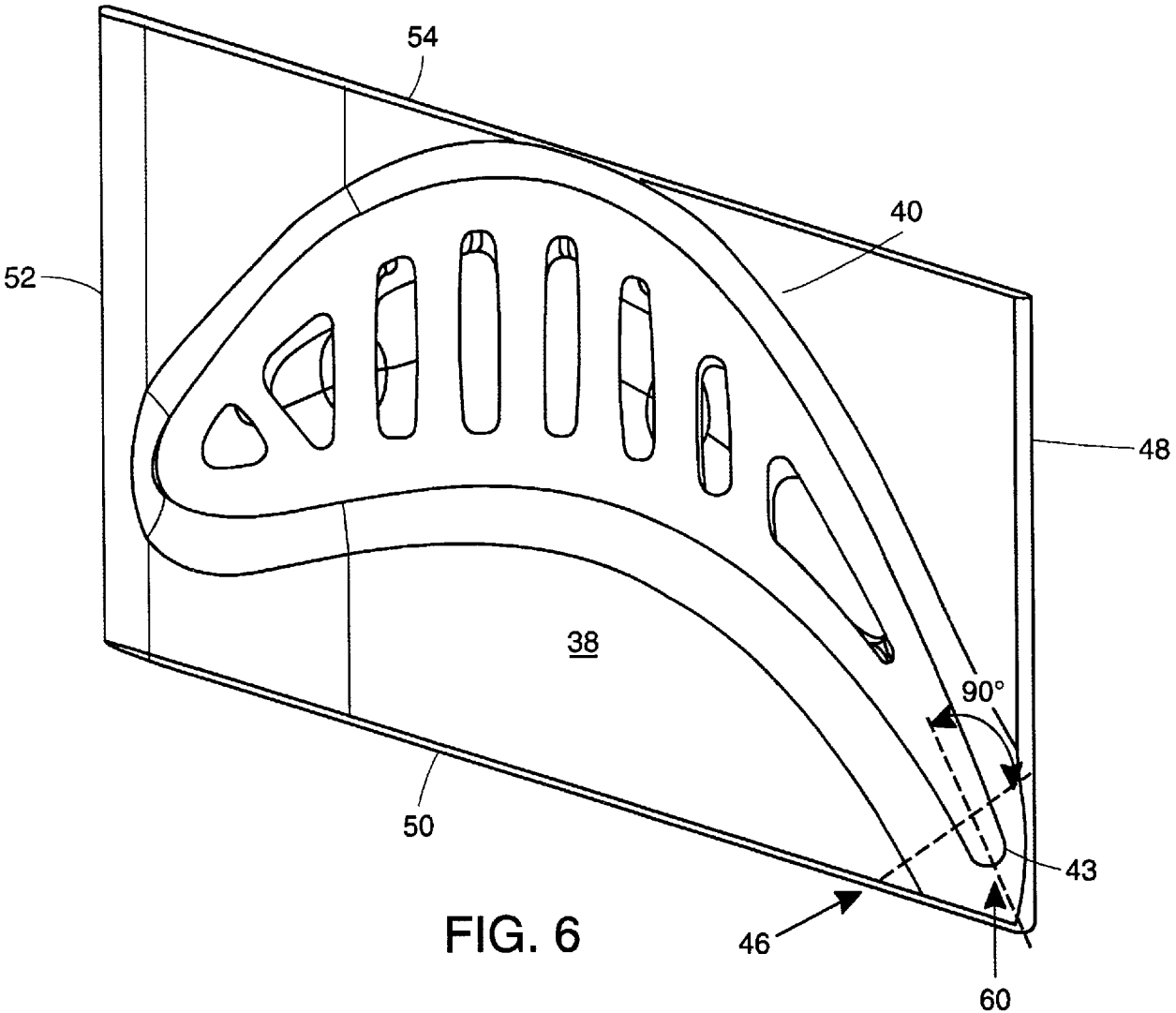
FIG. 6 is a cross sectional view, taken along line A—A of FIG. 4, of the turbine blade of the present invention.
Figure 7:
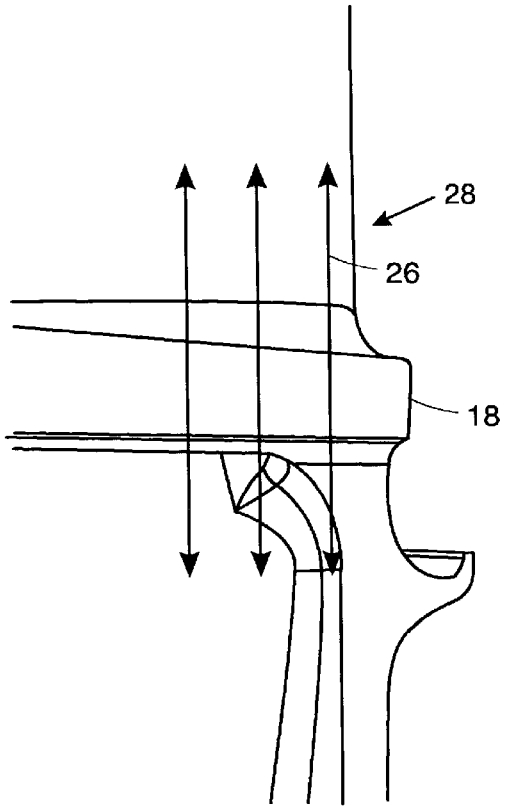
FIG. 7 PRIOR ART
FIG. 7 is a front side view showing the stress line in a prior art turbine blade.
Figure 8:
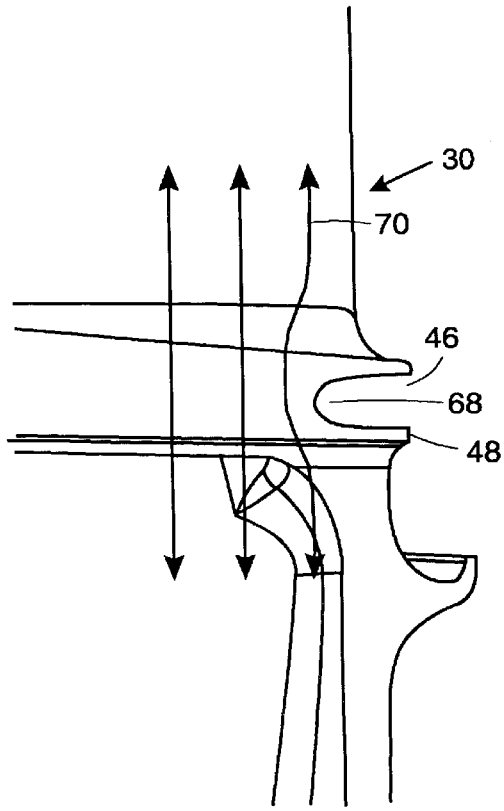
FIG. 8 is a front side view showing the stress line in a preferred embodiment of a turbine blade according to the present invention.

As seen in FIG. 6, the preferred orientation of groove 46 is at an angle of about 90 degrees from the mean camber line 60 at the trailing edge 43 of the airfoil 40. A prior art turbine blade 28 shown in FIG. 7 has a stress line 26 encountered by blade 28, or blade load, that includes stress distribution along the airfoil root trailing edge 18. As seen in FIG. 8, groove 46 has a depth 68 that will enter a stress line 70 (shown after alteration by groove 46) of turbine blade 30 caused by a load encountered by blade 30, or blade load. Thus, groove 46 causes a change to the load path direction away from the trailing edge 48. Consequently, the groove location and depth results in a reduced mechanical as well as thermal stress condition in the airfoil root trailing edge 48 and a higher stressed condition in the groove 46. An increase in the fatigue capability of this region of the component is possible because the groove 46 is located in a region of cooler metal temperatures having greater material fatigue strength. This groove 46 additionally provides a decrease in the mechanical stress in the trailing edge 48 by cutting into the load path of the airfoil, thus having an overall greater benefit in the fatigue life of the region. Also, the groove 46 is angled, such that the groove 46 begins on the concave side 50 of the platform and exits on the trailing edge side 48 of the bucket shank cover plate 56. This groove orientation has a significantly smaller effect on blade natural frequencies than a groove that completely extends from the concave side to the convex side of the blade, thereby further reducing the potential for increased mechanical vibratory stress in the airfoil.

Figure 9:
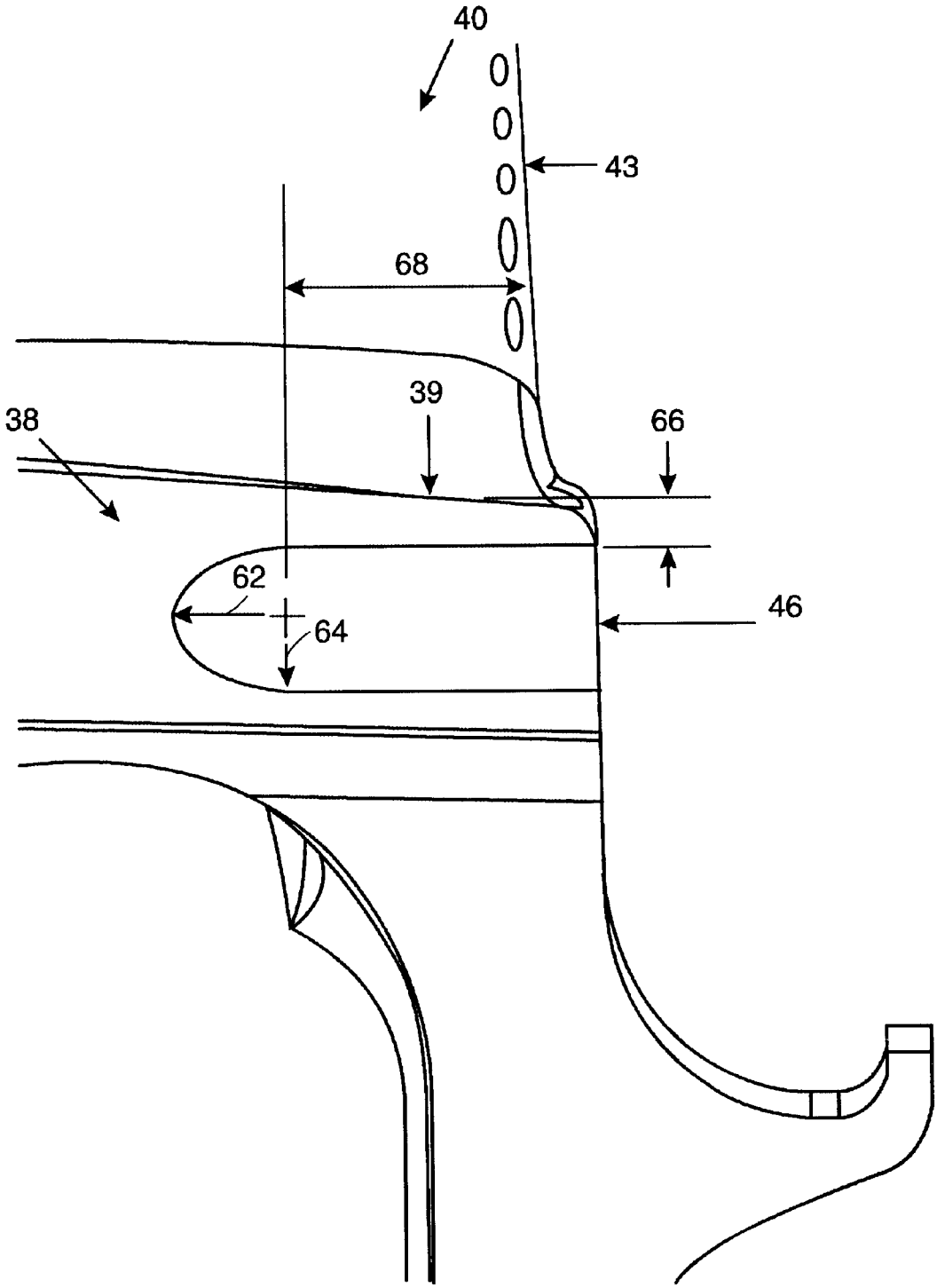
FIG. 9 is an elevation view of another preferred embodiment of the turbine blade of the present invention.

In alternative embodiments, the groove 46 may possess any of a number of shapes, such that the cross-section of the groove may be, but is not limited to, circular, elliptical, square, rectangular, or polygonal, in which the groove is defined by two or more planes. In a preferred embodiment of the present invention, the shape of the groove has an elliptical cross-section. In a most-preferred embodiment, as seen in FIG. 9, the elliptical groove 46 has a semi-major dimension 62 of 0.237" and a semi-minor dimension 64 of 0.160", based on an airfoil 40 height of 5.60". This embodiment has a preferred radial distance 66 from the groove 46 to the top 39 of the blade platform 38 of 0.085", and the depth 68 is 1.050". The depth 68 of the groove 46 is application specific, and controls the distribution of load between the groove and the airfoil trailing edge 48. Increasing the depth 68 decreases trailing edge stress and increases groove stress, and vice versa.

While the preferred form of the present invention has been described, variations thereof will occur to those skilled in the art within the scope of the present inventive concepts that are delineated by the following claims.

What is claimed is:

1. A gas turbine blade comprising:

a blade platform having a blade trailing edge side, a blade convex side, a blade concave side, and a blade leading edge side;

a blade profile portion connected to said blade platform; and a groove formed in said blade trailing edge side of said blade platform, wherein said groove begins on said blade concave side and exits on said blade trailing edge side.

2. The groove as claimed in claim 1, said groove being at an angle with respect to a mean camber line of a trailing edge of said blade profile portion.

3. The groove as claimed in claim 2, said angle being 90 degrees.

4. The groove as claimed in claim 1, said groove having a depth that will enter into a line of stress created by a blade load.

5. The gas turbine blade as claimed in claim 1, said groove having a substantially elliptical cross-section.

6. The gas turbine blade as claimed in claim 1, said groove having a substantially round cross-section.

7. A gas turbine blade comprising:

a blade platform having a blade trailing edge side, a blade convex side, a blade concave side, and a blade leading edge side;

a blade profile portion connected to the blade platform; and a groove formed in the blade platform, the groove having an elliptical cross-section and extending from the blade concave side to the blade trailing edge side at an angle of 90° with respect to a mean camber line of a trailing edge of the blade profile portion.

8. The gas turbine blade as claimed in claim 7, wherein the groove has a depth that will enter into a line of stress created by a blade load.

* * * * *